US006220388B1

(12) United States Patent
Sanborn

(10) Patent No.: US 6,220,388 B1
(45) Date of Patent: Apr. 24, 2001

(54) ACOUSTICAL INSULATION PANEL

(75) Inventor: David M Sanborn, Downers Grove, IL (US)

(73) Assignee: Strandtek International, Inc., Belleair Bluffs, FL (US)

( * ) Notice: Subject to any disclaimer, the term of this patent is extended or adjusted under 35 U.S.C. 154(b) by 0 days.

(21) Appl. No.: 09/492,217

(22) Filed: Jan. 27, 2000

(51) Int. Cl.[7] ..... E04B 1/82
(52) U.S. Cl. ..... 181/290; 181/292; 181/294
(58) Field of Search ..... 181/286, 290, 181/292, 294, 296; 428/116, 117, 297.1, 298.4, 903

(56) References Cited

U.S. PATENT DOCUMENTS 3,211,253 * 10/1965 Gonzalez ..... 181/292
3,502,171 * 3/1970 Cowan ..... 181/292
5,841,081 * 11/1998 Thompson et al. ..... 181/286

* cited by examiner

*Primary Examiner*—Khanh Dang
(74) *Attorney, Agent, or Firm*—A. W. Fisher, III

(57) ABSTRACT

An acoustical insulation panel to absorb and attenuate sound energy comprising an inner core including a plurality of cells formed therein and an outer membrane disposed on each side of the inner core to cooperatively form a plurality of sound attenuating chambers, each outer membrane includes an inner substrate of nonwoven meltblown microfiber acoustical absorbing fabric extending into each of the plurality of cells to cooperatively form the corresponding sound attenuating chamber therebetween and an outer facing to protect the corresponding inner substrate of nonwoven meltblown microfiber acoustical absorbing fabric.

29 Claims, 4 Drawing Sheets

ACOUSTICAL INSULATION PANEL

BACKGROUND OF THE INVENTION

1. Field of the Invention

An acoustical insulation panel to absorb and attenuate sound energy.

2. Description of the Prior Art

Various materials and structure have been developed to reduce sound transfer. The sound absorption characteristics of porous insulation materials is a function of the acoustic impedance of the material. Acoustic impedance consists of frequency dependart components acoustic resistance and acoustic reactance. Acoustic reactance depends largely by the thickness of the product and material to a lesser extent by the mass per unit area of an air permeable facing or film which may be applied over the surface of the porous insulation material. On the other hand, acoustic resistance depends on the air flow resistance of the porous insulation material.

U.S. Pat. No. 5,824,973 discloses porous insulation materials such as thermoplastic glass or polymeric fiber blankets and polymeric foams are used in many applications to enhance the sound absorbtion performance of various products and systems.

U.S. Pat. No. 5,804,512 shows a nonwoven laminate fabric comprising first and second nonwoven webs formed of spunbonded continuous filaments and a nonwoven web of meltblown microfibers having a basis weight between about one and twenty grams per square meter sandwiched between and bonded to the first and second nonwoven webs to form a composite nonwoven fabric.

U.S. Pat. No. 5,589,258 relates to a nonwoven material comprising a web of spunbond polymer filaments in combination with at least one other spunbond or meltblown nonwoven layer impregnated with a stabilizing agent.

U.S. Pat. No. 4,766,029 teaches a house wrap consists of a three-layer, semi-permeable, nonwoven laminate. The two exterior layers are spunbond polypropylene having a melt flow of 35 grams per ten minutes at 230° C. The interior layer is a two-component melt-blown layer of polyethylene and polypropylene.

U.S. Pat. No. 5,733,822 describes a composite nonwoven fabric comprising a web of thermoplastic filaments laminated to at least one other web. Preferably, the filaments are spunbonded continuous polyolefin filaments which have an oxidatively degraded outer sheath portion to promote better interfilamentary bonding and improved fabric laminate strength.

U.S. Pat. No. 5,733,635 shows a laminated non-woven fabric of a multi-layer structure comprising a layer of a composite, spun bond non-woven fabric composed of long fibers containing a low melting point resin component and a high melting point resin component, and a layer of a non-woven fabric of melt-blow ultrafine mixed fibers comprising low melting point ultrafine fibers and high melting point ultrafine fibers both of the fibers have an average fiber diameter of 10 um or less, both of the layers are laminated, and fibers in each of the non-woven fabrics and both of the layers are heat-melt adhered with each other.

U.S. Pat. No. 4,828,910 discloses a laminate structure comprising a core of resilient fibrous batt sandwiched between two facing sheets of reinforcing fibrous mat bonded together by a thermoset bonder into a unitary structure.

U.S. Pat. No. 5,824,973 shows a sound absorption laminate comprising a porous insulation substrate, such as, a glass, polymeric or natural fiber blanket or a foamed polymeric resin sheet and a facing sheet with a high air flow resistance. The facing sheet is superimposed upon a surface of the insulation substrate to augment the acoustical properties of the substrate. With the facing sheet the air flow resistance of the laminate is greater than the air flow resistance of the substrate and the laminate exhibits a higher sound absorption coefficient than the sound absorption coefficient of the substrate.

U.S. Pat. No. 5,536,556 discloses an insulating laminate, which is particularly suitable for a sound attenuating barrier including a finish lamina, which may be preferably cloth-like, and a substrate which is preferably structurally stable and self supporting and which may be adapted to absorb sound primarily at predetermined higher frequencies. In one preferred embodiment, a thin flexible film is located between the finish lamina and the substrate which is adapted to absorb sound primarily at relative lower predetermined frequencies. The film may include a pattern of openings or holes designed to absorb sound primarily at predetermined lower frequencies. In the disclosed embodiment, the substrate includes a porous fiber mat, preferably including fibers having a range of thicknesses to improve sound attenuation at higher frequencies, a structural foam lamina and a reinforcing scrim, preferably comprising spunbonded polyester filaments.

U.S. Pat. No. 4,948,660 shows a heat and sound insulating panel comprising an insulating layer of mineral fibers bonded by a synthetic resin and surfacing layer consisting of a sheet of glass fibers. Between these two layers is a heat-sealing film such as polyethylene, having a low level of steam permeability and an aluminum film of a thickness less than or equal to 9 microns glued to the glass sheet.

U.S. Pat. No. 4,898,783 teaches a thermal insulating and sound absorbing structure comprising a batting of resilient, elongatable, non-flammable non-linear carbonaceous fibers having a reversible deflection ratio of greater than 1.2:1, an aspect ratio greater than 10:1 and an LOI value greater than 40.

U.S. Pat. No. 5,298,694 shows a method for attenuating sound waves passing from a source area to a receiving area comprising the steps of providing a nonwoven acoustical insulation web including thermoplastic fibers. (The web has an average effective fiber diameter of less than about 15 microns, a density of less than about 50 kg/m3, and an air pressure drop across the web of at least about 1 mm water at a flow rate of about 32 liters/min) and positioning the web between the source area and the receiving area such that a major face of the web intercepts and thereby attenuates sound waves passing from the source area to the receiving area. In addition a laminate may be applied to the inner panel and a second layer, such as a scrim, nonwoven fabric, film, or foil, laminated thereto.

U.S. Pat. No. 5,554,831 relates to a sound absorbing member comprising a fiber assembly consisting essentially of short fibers and having a thickness of not less than 5 mm, in which new and/or recycled polyester fibers are used as the short fiber and not less than 30% by weight of the polyester fiber used have a fiber-size of not more than 4 denier.

U.S. Pat. No. 5,683,794 shows a multilayered nonwoven composite web particularly useful as a substitute for a woven web such as a textile web, and having improved liquid wicking and retention properties comprising a first layer of fibrous material selected from the group consisting of thermoplastic meltblown man-made fibers, thermoplastic spunbonded man-made fibers, thermoplastic man-made staple fibers and combinations thereof, this first layer being light weight, and a second layer of cellulosic-based fibers, preferably cotton fibers, the first and second layers being thermally bonded together over about 5 to 75% of the surface area of the web to form a coherent web having an air permeability of between about 25 and about 37 ft3/min/ft3 (0.127 and 0.188 m3/sec/m2). In a preferred embodiment, the composite web includes at least a third layer of thermoplastic man-made fibers and the layer of cellulose-based fibers is sandwiched between the two layers of thermoplastic man-made fibers.

U.S. Pat. No. 5,773,375 describes a polypropylene melt-blown microfiber acoustical insulation web which has a resistance to thermal degradation at a temperature of 135° C. for at least 10 days. The polypropylene has a thermal stabilizer uniformly distributed within the melt-blown microfiber polymer which polymer when produced is subject to thermal and/or catalytic degradation in the absence of significant levels of thermal stabilizer or antioxidant.

U.S. Pat. No. 5,817,408 teaches a sound insulating structure including low-density and high-density layers. The low-density layer has first and second fibrous layers and ranges from 0.5 to 1.5 kg/m2 in surface density. The first and second fibrous layers are respectively made of first and second thermoplastic synthetic fibers. The first and second fibers respectively have first and second single fiber diameters, each of which diameters is in a range of from 3 to 40 mcg, and first and second fiber lengths, each of which lengths is in a range of from 10 to 100 mm. The high-density layer is formed on the low-density layer and is made of an air-impermeable polymer material and has a surface density that is higher that of the low-density layer and ranges from 1 to 10 kg/m2.

U.S. Pat. No. 4,780,359 relates to a nonwoven textile panel for use as a fire retardant and sound deadening barrier in the interiors of aircraft comprising three layers of nonwoven textile fibers of polyphenylene sulfide fibers and Nomex brand aramid fibers that have been carded, cross-lapped, needle punched and thermally bonded by heating the panel to the temperature softening point of the polyphenylene sulfide fibers.

U.S. Pat. No. 4,851,283 discloses a thermoformable laminate suitable for use as automobile headliners, comprising a layer of non-woven fabric acoustical pad bonded to one side of a foamed polymer sheet.

U.S. Pat. No. 4,900,619 shows a translucent nonwoven fabric composite suitable for use as a housewrap comprising a meltblown fabric layer laminated to a reinforcing fabric layer with tacking strips. The composite may be prepared by calendering a meltblown fabric and a reinforcing fabric together in a nip equipped with a resilient roll.

U.S. Pat. No. 5,459,291 teaches a sound absorption laminate comprising a porous insulation substrate, such as, a thermoplastic glass or polymeric fiber blanket or a foamed polymeric resin sheet and a facing sheet with a high air flow resistance. The facing sheet is adhered to a surface of the porous insulation substrate to augment the acoustical properties of the substrate. With the facing sheet the air flow resistance of the laminate is greater than the air flow resistance of the substrate and the laminate exhibits a higher sound absorption coefficient than the sound absorption coefficient of the substrate. Thus, the laminate exhibits better sound absorption properties than the substrate and is suitable for sound absorption applications for which the substrate alone would not be suitable.

U.S. Pat. No. 5,149,920 shows an acoustical panel comprising a compressed and cured mass of binder impregnated randomly oriented and interentangled fibrous glass bundles characterized by high sound absorption coefficients at low frequencies.

U.S. Pat. No. 4,838,380 discloses a nylon impression fabric used as a cover fabric for an acoustical material (e.g., 1 inch thick polyester foam) substrate in an environment-such as a textile workplace environment having textile machinery such as texturing air jets-to provide for good sound absorption while being easily cleanable, and having other desirable properties that lead to significant high frequency (e.g., 4000–20000 Hz) noise reduction over long periods of time. The fabric combination has an HFNRC (high frequency noise reduction coefficient) of at least about 0.80. The facing fabric has a fractional cover factor of about 0,80, a coefficient of friction of less than about 0.30, an air porosity of about 10–50 cfm, and a Taber abrasion resistance of greater than about 400 cycles. The facing fabric preferably is uncoated, and is not fill surface bonded to the substrate (e.g., either wrapped or point bonded).

U.S. Pat. No. 4,729,917 describes a method for thermoforming three dimensionally contoured parts from a laminate comprising a stiff thermoformable polystyrene foam core to either side of which is laminated a porous, nonextendable rigidifying material is arranged so as to be subjected to two dimensional contouring but so as not to extend onto areas of laminate which will be subject to severe three dimensional contouring.

U.S. Pat. No. 4,615,411 relates to a sound-insulated flow duct with walls made up of a composite of an elastic thermoplastic, predominantly closed-cell foam material as the inner layer.

U.S. Pat. No. 4,450,195 shows a hygienic absorbent, i.e. a substantially liquid and gas tight sound absorbent, including an under-absorbent, a tight foil and gas-filled blisters located therebetween. Preferably a supporting layer is located outside the under-absorbent to support the blisters.

U.S. Pat. No. 4,347,912 discloses an airbome-sound-absorbing wall or ceiling paneling comprises a perforated plate having a hole-area proportion L and a nonwoven fabric bonded thereto by a discontinuously distributed adhesive layer. The nonwoven fabric has an open-area proportion N and an air flow resistance W, in the zones free of adhesive, said perforated plate being mountable at a spacing from a wall or ceiling that is large in relation to the thickness of nonwoven fabric. The paneling has a total air flow resistance W and the adhesive layer is applied to the nonwoven fabric in the form of a fine pattern. The proportion per unit area of the nonwoven fabric which is not covered with adhesive is approximately equal to the ratio of its air flow resistance W and the hole-area proportion L divided by the desired total air flow resistance W.

U.S. Pat. No. 4,301,890 relates to a non-porous sound-absorbing panel which can be readily cleaned and which is intended for use in high humidity, sanitary environments. The panel comprises two non-porous membranes or panels bonded to opposite sides of a honeycomb structure. At least one membrane natural frequency, the membrane/honeycomb cavity natural frequency and the standing wave natural frequency of the honeycomb cavities being closely matched. In a preferred embodiment of the invention, the membrane comprises a polyurethane panel; while the honeycomb structure is formed from phenolic impregnated paper.

U.S. Pat. No. 4,253,543 teaches a device for absorption of airborne sound comprising a rigid, air permeable and self-supporting carrying layer having a flexible, air impermeable membrane applied thereto. The device is characterized in that the carrying layer has an air flow resistance of less than 10,000 Pas/m, that the layer has a thickness of 1–60 mm, preferably 5–20 mm, and that at least one surface of the layer is provided with a relief pattern. The device is further characterized in that a flexible membrane having a surface weight of less than 2 kg/m$^2$ is firmly attached to the carrying layer by gluing or the like. The membrane is resting on the upper parts of the relief pattern, whereby an air gap is obtained between the membrane and the lower parts of the relief pattern.

U.S. Pat. No. 4,129,672 describes an auto ceiling panel which represents a metal lath coated with plastics around the meshes, both sides of the metal lath being attached by thermal fusion with a foamed polyethylene layer having numerous through holes and with a foamed urethane slab having continuous bubbles, characterized by high permeability and high open rate; and the manufacturing process of this auto ceiling panel.

U.S. Pat. No. 4,111,081 discloses a sound attenuating laminate exhibiting a relatively low change in acoustic resistance with respect to particle velocity is disclosed. The laminate includes a gas permeable mat of randomly arranged, small diameter filaments interleaved between two layers of resin impregnated, open weave web or cloth. A predetermined pattern of adhesive applied to the filamentous mat penetrates the mat to bond the laminate into an integral structure. The laminate can be easily fabricated to form sound attenuating panels having a variety of contours by curing the composite within a mold.

U.S. Pat. No. 4,097,633 teaches an embossed film-to-foam laminate having minute perforations through the film selectively distributed essentially along the sidewalls and valleys of the embossed pattern. The integrity of the laminated film material is retained on the crowns of the embossed patterned surface, since the perforations in the film material are mainly distributed on the sidewalls and valleys of the embossed pattern. The laminated product has a water-resistant and abrasion-resistant upper surface imparted by the film material on the crowns while the small perforations in the sidewalls and valleys permit sound to pass through the film and be exposed to the acoustical matrix of the open cell foam component of liquids (e.g. water) through the film into the foam under the action of gravity. The film and/or the foam material are heated to supply adhesive material by melting or softening which serves to bond the film material to the foam.

U.S. Pat. No. 4,076,100 shows an acoustical board formed of fire retardant materials which board has the unique qualities of being fire retardant, sound absorbing, heat insulating, and decorative, and may be formed virtually in any desired size and shape. It is composed of fiberglass reinforced melamine resin panels or the like having one grooved areas of the underlying board in such manner as to trap, and debilitate such sound waves therein, and, it has been particularly formed so as to be oil impervious, while retaining tie sound deadening qualities by the insertion of a thin membrane of oil impervious material between the fiberglass cloth and the melamine panel.

U.S. Pat. No. 3,985,198 relates to a laminate of a covering stratum of closed-cell soft foam having a bulk density of less than about 50 kp/m$^3$, and a core stratum having cavities and joined to the covering stratum at locations spaced from one another by a distance less than about 10 times the thickness of the covering stratum the total area of the joinders between the covering stratum and the core stratum being less than about ⅔ of the covering stratum area. The core stratum may have a honeycombed structure, such as expanded sheet metal, a closed-cell soft foam possibility in granular form, etc. The laminate may include additionally an additional covering stratum on the other side of the core stratum or multiple layers of alternating covering and core strata. A paper sheet may be provided on the last core stratum for cementing to a surface. Reinforcements can be provided embedded in or on the back of the core stratum, e.g. a metal sheet. Expanded metal sheet can simultaneously. Expanded metal sheet can simultaneously function as core and reinforcement, permitting the laminate to be rolled in one direction for ease of transport.

U.S. Pat. No. 3,972,383 teaches a system for varying the acoustic resistance of a acoustical lining disposed in a duct of an air propulsor comprises a nonlinear sound suppression liner having a porous facing sheet overlying a plurality of cells and for impinging a predetermined oscillatory air pressure signal of 100–160 dB at an inaudible frequency on the facing sheet to vary the acoustic resistance of the facing sheet to make it optimum for selected sound level airflow condition in the duct.

U.S. Pat. No. 3,783,969 shows an acoustic insulation comprising anisometric compressed and bonded knitted wire mesh composites composed of a plurality of sheets of knitted wire mesh, superimposed at random orientation with respect to each other, compressed or densified to a voids volume within the range from about 10 to 90 percent and bonded together. The sheets are taken in sufficient number, usually at least five and preferably 10 or more, and as much as 1,000 or more, to form a self-supporting relatively non-resilient composite of high tensile strength and high breaking strength having an average pore diameter of less than 200 microns, and preferably less than 100 microns, that is relatively uniform in any unit area of the surface, and having an anisometric porosity, the through pores extending crosswise of the sheet greatly exceeding in number the through pores extending laterally of the sheet, which latter pores can be reduced virtually to zero in a highly compressed composite. The composite is formed by superimposing a plurality of knitted wire mesh sheets, annealing the composite to avoid wire breakage during later processing, compressing the composite to the desired density and anisometricity by application of pressure in a direction approximately perpendicular to the plane of the layers of the composite, and bonding the sheet layers and the wire filaments of the sheets together at their points of contact and/or crossing. The bonding holds the composite at the selected density, prevents relative movement of the wires in the composite, and in conjunction with the multilayer structure imparts the self-supporting nonresilient characteristic, together with high tensile strength and high breaking strength.

U.S. Pat. No. 3,773,141 discloses a sound-proofing structural element for the formation of a wall, in particular of a housing wall of an engine of machine, comprising a number of intersecting webs on at least one of its outer surfaces, the predetermined ratio between the wall thickness of the structural element, the dimensions of the webs and the clearances between them being such as to reduce the sound generation of the structural element.

U.S. Pat. No. 3,44,956 teaches an acoustical panel for use on ceilings, walls, and the like comprising a body layer of porous material, preferably fiberboard, and a surface layer of open-cell foam and in which there are a multiplicity if acoustical openings at the surface are closed by U.S. Pat. No. 3,412,513 shows a sound-absorbing structural element including two outer plate-shaped members, a sheet of sound absorbing material between the plate-shaped members, a plurality of hollow spaces between at least one of the outer plate-shaped members and the sheet of sound absorbing material, and the hollow spaces being filled with a heavy bulk material such as sand, chipped stone, and the like.

U.S. Pat. No. 3,182,747 discloses a self-supporting independent sound absorbing sheet having a thickness ranging from at least about 0.5 mm to about 5 mm possessing an open micro-porous structure mounted at a predetermined distance from a wall to operate as sound absorbing means.

Despite these numerous efforts there remains a need for a lightweight, low cost sound absorbing panel.

SUMMARY OF THE INVENTION

The present invention relates to an acoustical insulation panel to absorb and attenuate sound energy.

The acoustical insulation panel comprises an inner core including a plurality of cells formed therein and an outer membrane disposed on at least one side of the inner core to cooperatively form a plurality of sound attenuating chambers. Each outer membrane comprises an inner substrate of nonwoven meltblown microfiber acoustical absorbing fabric extending tuft and an outer facing to protect the inner substrate of nonwoven meltblown microfiber acoustical absorbing fabric. The inner core comprises a honeycomb structure formed by a plurality of interconnecting cell side walls to form the plurality of cells. So fabricated, the acoustical insulation panel is suitable for use as acoustical wall panels, ceiling panels and office partitions, automotive headliners and hoodliners, liners for heating, ventilating and air conditioning systems, appliance insulation and similar such applications.

The invention accordingly comprises the features of construction, combination of elements, and arrangement of parts which will be exemplified in the construction hereinafter set forth, and the scope of the invention will be indicated in the claims.

BRIEF DESCRIPTION OF THE DRAWINGS

For a fuller understanding of the nature and object of the invention, reference should be had to the following detailed description taken in connection with the accompanying drawings in which.

Similar reference characters refer to similar parts throughout the several views of the drawings.

DETAILED DESCRIPTION OF THE INVENTION

Figure 1:
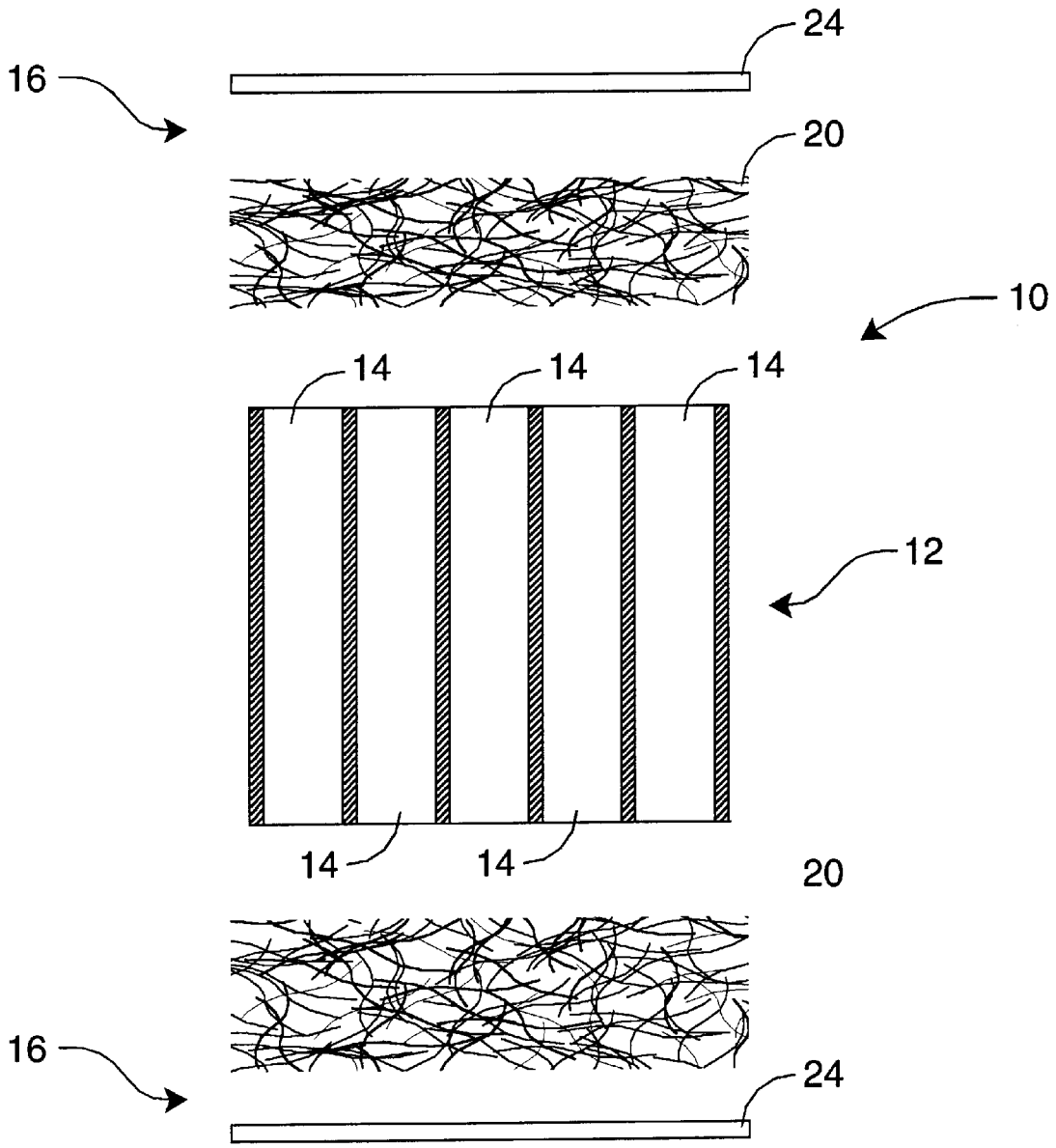
FIG. 1 is an exploded side view of the acoustical insulation panel of present invention.
Figure 2:
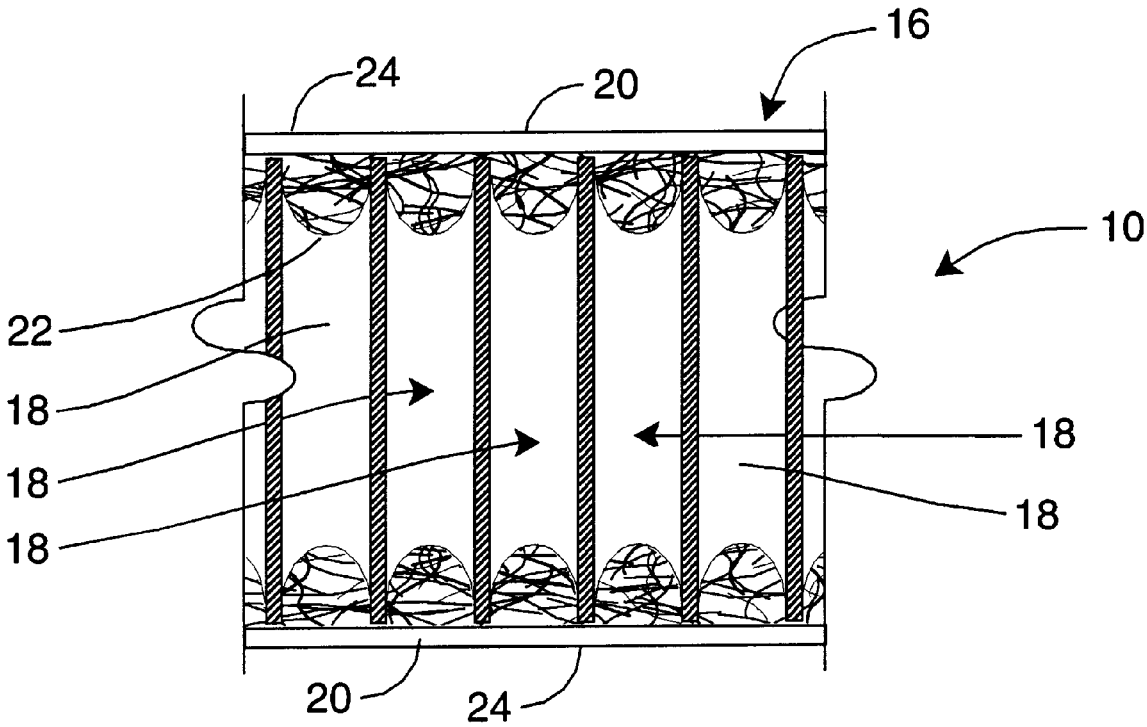
FIG. 2 is a detailed partial cross-sectional side view of the acoustical insulation panel of present invention.
Figure 3:
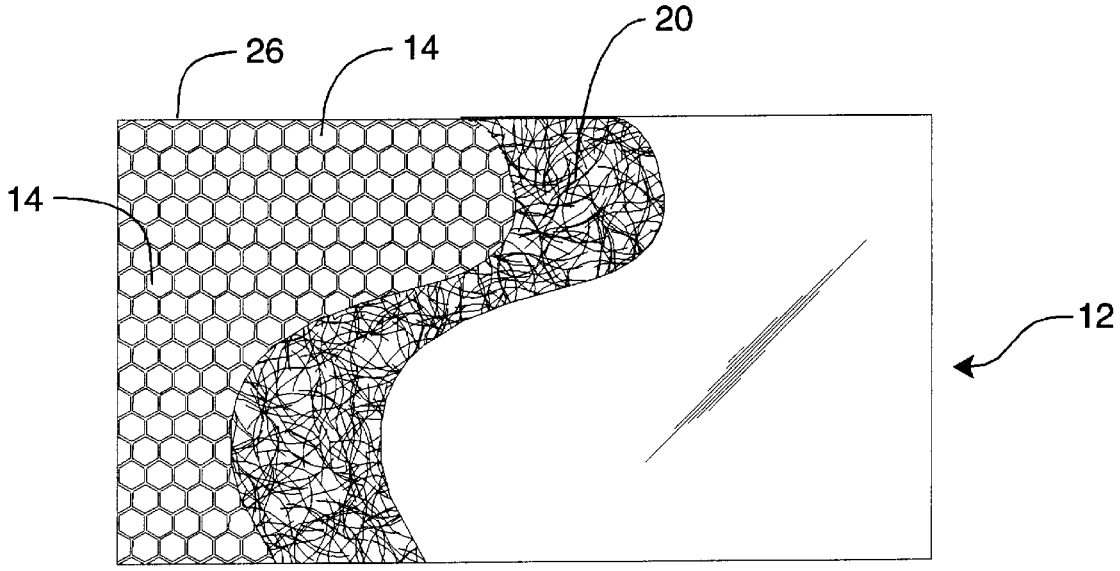
FIG. 3 is a top view of the inner core of the acoustical insulation panel of present invention.

As shown in FIGS. 1 through 3, the present invention relates to an acoustical insulation panel generally indicated as 10 to absorb and attenuate sound energy.

As shown in FIGS. 1 through 3, the acoustical insulation panel 10 comprises an inner core generally indicated as 12 including a plurality of cells each indicated as 14 formed therein and an outer membrane generally indicated as 16 disposed on each side of the inner core 12 to cooperatively form a plurality of sound attenuating chambers each indicated as 18. Each outer membrane 16 comprises an inner substrate of nonwoven meltblown microfiber acoustical absorbing fabric 20 extending into each of the plurality of cells 14 forming a corresponding sound absorbing tuft and fabric element or button each indicated as 22 and an outer facing 24 to protect the corresponding inner substrate of nonwoven meltblown microfiber acoustical absorbing fabric 20. Each inner substrate of nonwoven meltblown microfiber acoustical absorbing fabric 20 may comprise a plurality of fine or superfine thermoplastic fibers. Each of the plurality of the sound attenuating chambers 18 is formed between the corresponding sound absorbing tuft and fabric element or button 22 extending into opposite ends of the corresponding cell 14.

As best shown in FIG. 3, the inner core 12 comprises a honeycomb structure formed by a plurality of interconnecting cell side walls 26 to form the plurality of cells 14 which, in turn, form the plurality of sound attenuating chambers 18 in cooperation with the plurality sound absorbing tufts and fabric elements or buttons 22 created by pressing the outer membrane 16 against opposite sides of the inner core 12 forcing the inner substrate of nonwoven meltblown microfiber acoustical absorbing fabric 20 into the plurality of cells 14 under pressure and temperature forming the plurality of sound absorbing tuft and fabric element or button 22 in the outer end portions of the plurality of cells on opposite sides of the inner core 12.

So fabricated, the acoustical insulation panel 10 is suitable for use as acoustical wall panels, ceiling panels and office partitions, automotive headliners and hoodliners, liners for heating, ventilating and air conditioning systems, appliance insulation and similar such applications.

Figure 4:
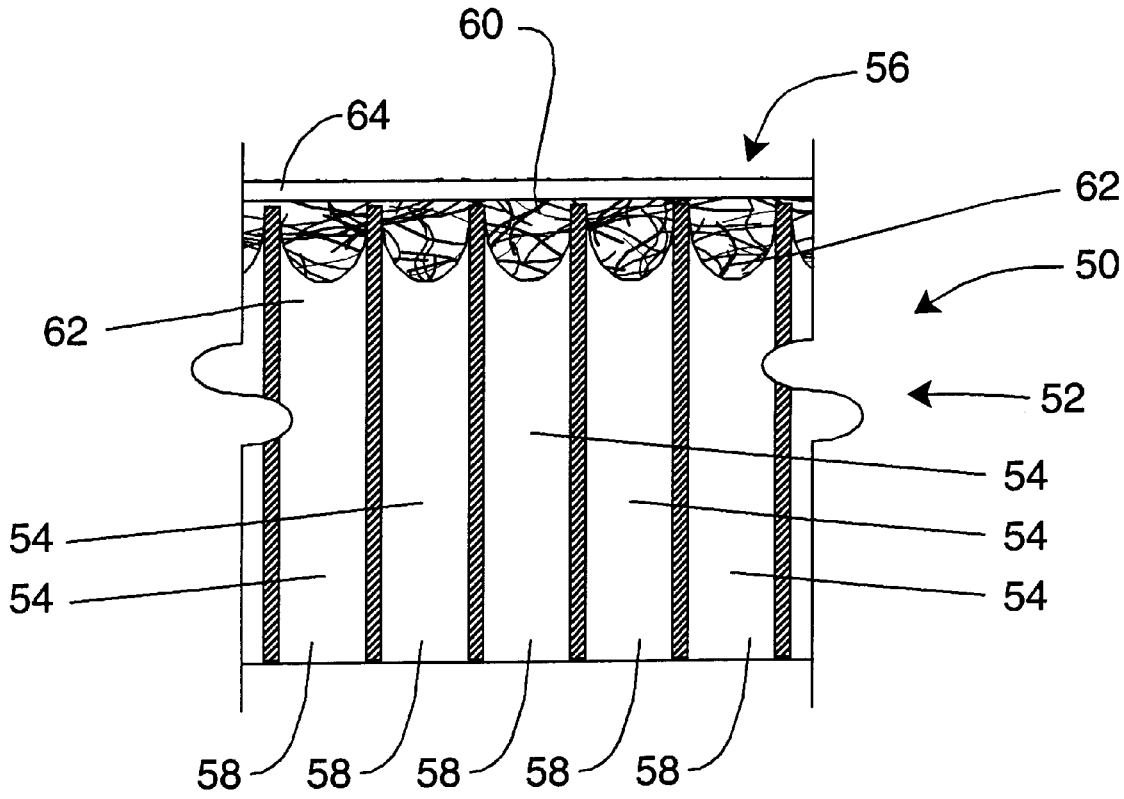
FIG. 4 is a cross-sectional side view of an alternate view embodiment of the acoustical insulation panel of present invention.

FIG. 4 shows an alternate embodiment of acoustical insulation panel generally indicated as 50.

The acoustical insulation panel 50 comprises an inner core generally indicated as 52 including a plurality of cells each indicated as 54 formed therein an outer membrane generally indicated as 56disposed on each side of the inner core 52 to cooperatively form a plurality of sound attenuating chambers each indicated as 58. The outer membrane 56 comprises an inner substrate of nonwoven meltblown microfiber acoustical absorbing fabric 60 extending into each of the plurality of cells 54 forming a corresponding sound absorbing tuft and fabric element or button each indicated as 62 and an outer facing 64 to protect the corresponding inner substrate of nonwoven meltblown microfiber acoustical absorbing fabric 60. Each inner substrate of nonwoven meltblown microfiber acoustical absorbing fabric 60 may comprise a plurality of superfine thermoplastic fibers. Each of the plurality of the sound attenuating chambers 58 is formed between the corresponding sound absorbing tuft and fabric element or button 62 extending into the end of the corresponding cell 54 and a wall or other such structure. The inner core 52 comprises a honeycomb structure formed by a plurality of interconnecting cell side walls 66 to form the plurality of cells 54 which, in turn, form the plurality of sound attenuating chambers 58 in cooperation with the plurality sound absorbing tufts and fabric elements or buttons 62 created by pressing the outer membrane 56 against side of the inner core 52 forcing the inner substrate of nonwoven meltblown microfiber acoustical absorbing fabric 60 into the plurality of cells 54 under pressure and temperature forming the plurality of sound absorbing tuft and fabric element or button 62 in the outer end portions of the plurality of cells on opposite sides of the inner core 52.

So fabricated, the acoustical insulation panel 50 is suitable for use as acoustical wall panels, ceiling panels and office partitions, automotive headliners and hoodliners, liners for heating, ventilating and air conditioning systems, appliance insulation and similar such applications.

It will thus be seen that the objects set forth above, among those made apparent from the preceding description are efficiently attained and since certain changes may be made in the above construction without departing from the scope of the invention, it is intended that all matter contained in the above description or shown in the accompanying drawing shall be interpreted as illustrative and not in a limiting sense.

It is also to be understood that the following claims are intended to cover all of the generic and specific features of the invention herein described, and all statements of the scope of the invention which, as a matter of language, might be said to fall therebetween.

Now that the invention has been described,

What is claimed is:

1. An acoustical insulation panel to absorb and attenuate sound energy comprising an inner core including a plurality of cells formed therein and an outer membrane disposed on one side of the inner core to cooperatively form a plurality of sound attenuating columns, said outer membrane includes an inner substrate of nonwoven meltblown microfiber acoustical absorbing fabric extending into each of the plurality of cells to cooperatively form said corresponding sound attenuating column and an outer facing to protect said inner substrate of nonwoven meltblown microfiber acoustical absorbing fabric.

2. The acoustical insulation panel of claim 1 wherein said inner substrate of nonwoven meltblown microfiber acoustical absorbing fabric extends into each of said plurality of cells forming a corresponding sound absorbing tuft and fabric element button.

3. The acoustical insulation panel of claim 2 wherein said substrate of nonwoven meltblown microfiber acoustical absorbing fabric comprises a plurality of fine or superfine thermoplastic fibers.

4. The acoustical insulation panel of claim 3 wherein said inner core comprises a honeycomb structure formed by a plurality of interconnecting cell side walls to form said plurality of cells.

5. The acoustical insulation panel of claim 1 wherein said inner core comprises a honeycomb structure formed by a plurality of interconnecting cell side walls to form said plurality of cells.

6. The acoustical insulation panel of claim 5 wherein said inner substrate of nonwoven meltblown microfiber acoustical absorbing fabric extends into each of said plurality of cells forming a corresponding sound absorbing tuft and fabric element button.

7. The acoustical insulation panel of claim 6 The acoustical insulation panel of claim 2 wherein said substrate of nonwoven meltblown microfiber acoustical absorbing fabric comprises a plurality of fine or superfine thermoplastic fibers wherein said substrate of nonwoven meltblown microfiber acoustical absorbing fabric comprises a plurality of fine or superfine thermoplastic fibers.

8. An acoustical insulation panel to absorb and attenuate sound energy comprising an inner core including a plurality of cells formed therein and an outer membrane disposed on each side of said inner core to cooperatively form a plurality of sound attenuating chambers, each said outer membrane includes an inner substrate of nonwoven meltblow microfiber acoustical absorbing fabric extending into each of the plurality of cells to cooperatively form the corresponding sound attenuating chamber therebetween and an outer facing to protect the corresponding inner substrate of nonwoven meltblow microfiber acoustical absorbing fabric.

9. The acoustical insulation panel of claim 8 wherein said inner substrate of nonwoven meltblown microfiber acoustical absorbing fabric extends into each of said plurality of cells forming a corresponding sound absorbing tuft and fabric element button.

10. The acoustical insulation panel of claim 9 wherein said substrate of nonwoven meltblown microfiber acoustical absorbing fabric comprises a plurality of fine or superfine thermoplastic fibers.

11. The acoustical insulation panel of claim 10 wherein said inner core comprises a honeycomb structure formed by a plurality of interconnecting cell side walls to form said plurality of cells.

12. The acoustical insulation panel of claim 8 wherein said inner core comprises a honeycomb structure formed by a plurality of interconnecting cell side walls to form said plurality of cells.

13. The acoustical insulation panel of claim 12 wherein said inner substrate of nonwoven meltblown microfiber acoustical absorbing fabric extends into each of said plurality of cells forming a corresponding sound absorbing tuft and fabric element button.

14. The acoustical insulation panel of claim 13 The acoustical insulation panel of claim 2 wherein said substrate of nonwoven meltblown microfiber acoustical absorbing fabric comprises a plurality of fine or superfine thermoplastic fibers wherein said substrate of nonwoven meltblown microfiber acoustical absorbing fabric comprises a plurality of fine or superfine thermoplastic fibers.

15. An acoustical insulation panel to absorb and attenuate sound energy comprising an inner core including a plurality of cells formed therein and an outer membrane disposed on each side of said inner core to cooperatively form a plurality of sound attenuating chambers, each said outer membrane includes an inner substrate of nonwoven meltblow microfiber acoustical absorbing fabric extending into each of the plurality of cells to cooperatively form the corresponding sound attenuating chamber therebetween.

16. The acoustical insulation panel of claim 15 further including an outer facing to protect said corresponding inner substrate of nonwoven meltblow microfiber acoustical absorbing fabric.

17. The acoustical insulation panel of claim 16 wherein said inner substrate of nonwoven meltblown microfiber acoustical absorbing fabric extends into each of said plurality of cells forming a corresponding sound absorbing tuft and fabric element button.

18. The acoustical insulation panel of claim 17 wherein said substrate of nonwoven meltblown microfiber acoustical absorbing fabric comprises a plurality of fine or superfine thermoplastic fibers.

19. The acoustical insulation panel of claim 18 wherein said inner core comprises a honeycomb structure formed by a plurality of interconnecting cell side walls to form said plurality of cells.

20. The acoustical insulation panel of claim 16 wherein said inner core comprises a honeycomb structure formed by a plurality of interconnecting cell side walls to form said plurality of cells.

21. The acoustical insulation panel of claim 20 wherein said inner substrate of nonwoven meltblown micmfiber acoustical absorbing fabric extends into each of said plurality of cells forming a corresponding sound absorbing tuft and fabric element button.

22. The acoustical insulation panel of claim 21 wherein said substrate of nonwoven meltblown microfiber acoustical absorbing fabric comprises a plurality of fine or superfine thermoplastic fibers wherein said substrate of nonwoven meltblown microfiber acoustical absorbing fabric comprises a plurality of fine or superfine thermoplastic fibers.

23. The acoustical insulation panel of claim 15 wherein said inner substrate of nonwoven meltblown microfiber acoustical absorbing fabric extends into each of said plurality of cells forming a corresponding sound absorbing tuft and fabric element button.

24. The acoustical insulation panel of claim 23 wherein said substrate of nonwoven meltblown microfiber acoustical absorbing fabric comprises a plurality of fine or superfine thermoplastic fibers.

25. The acoustical insulation panel of claim 24 wherein said inner core comprises a honeycomb structure formed by a plurality of interconnecting cell side walls to form said plurality of cells.

26. The acoustical insulation panel of claim 23 wherein said inner core comprises a honeycomb structure formed by a plurality of interconnecting cell side walls to form said plurality of cells.

27. The acoustical insulation panel of claim 26 wherein said inner substrate of nonwoven meltblown microfiber acoustical absorbing fabric extends into each of said plurality of cells forming a corresponding sound absorbing tuft and fabric element button.

28. The acoustical insulation panel of claim 27 wherein said substrate of nonwoven meltblown microfiber acoustical absorbing fabric comprises a plurality of fine or superfine thermoplastic fibers wherein said substrate of nonwoven meltblown microfiber acoustical absorbing fabric comprises a plurality of fine or superfine thermoplastic fibers.

29. The acoustical insulation panel of claim 28 further including an outer facing to protect said corresponding inner substrate of nonwoven meltblow microfiber acoustical absorbing fabric.

* * * * *